US005452558A

United States Patent [19]

Eastin

[11] Patent Number: 5,452,558

[45] Date of Patent: Sep. 26, 1995

[54] METHOD FOR PERMANENTLY REPAIRING AND SEALING ROOFS

[76] Inventor: Gary Eastin, 1179 Iris La., Salt Lake City, Utah 84106

[21] Appl. No.: 225,798

[22] Filed: Apr. 11, 1994

[51] Int. Cl.[6] ..... E04G 23/02

[52] U.S. Cl. ..... 52/741.4; 52/514; 405/152

[58] Field of Search ..... 52/514.5, 514, 52/408, 410, 741.4, 745.21, 169.14; 405/152

[56] References Cited

U.S. PATENT DOCUMENTS

| | | | |
|---|---|---|---|
| 2,631,360 | 3/1953 | Ea-Sanford et al. | 52/514 X |
| 3,345,246 | 10/1967 | Sheahan | 52/514 |
| 4,712,348 | 12/1987 | Triplett | 52/408 |
| 4,783,942 | 11/1988 | Nunley | 52/408 X |
| 4,810,573 | 3/1989 | Harriett | 52/169.14 X |
| 5,079,088 | 1/1992 | McGroarty et al. | 52/408 X |
| 5,158,803 | 10/1992 | Haas | 52/741.4 X |
| 5,226,279 | 7/1993 | Rendon-Herrero | 52/741.4 X |

FOREIGN PATENT DOCUMENTS

| | | | |
|---|---|---|---|
| 350022333 | 7/1975 | Japan | 52/741.4 |
| 405125841 | 5/1993 | Japan | 52/514 |

*Primary Examiner*—Carl D. Friedman
*Assistant Examiner*—Yvonne Horton-Richaroson
*Attorney, Agent, or Firm*—Terry M. Crellin

[57] ABSTRACT

A method is disclosed for permanently repairing roofs using a colloidal clay such as sodium montmorillonite (commonly called bentonite). A layer of particles of the colloidal clay is spread on the surface of the roof that is to be repaired so that the layer of colloidal clay covers any cracks or openings in the roofing material that are causing leaks. A membrane made of water impermeable material is then applied over the layer of colloidal clay particles so as to confine the particles underneath the membrane. During a rainstorm, water wets the colloidal clay, and the clay swells rapidly to form a water tight blockage between the roof and the membrane. Rain water cannot infiltrate beneath the membrane and thus cannot leak through holes or openings in the roof material that have been covered by the layer of colloidal clay and the membrane. The colloidal clay material is held permanently in place beneath the membrane, and thus the repair is a permanent repair rather than a temporary repair.

5 Claims, 3 Drawing Sheets

METHOD FOR PERMANENTLY REPAIRING AND SEALING ROOFS

BACKGROUND OF THE INVENTION

1. Field of the Invention

The present invention relates to methods of repairing and installing roofs, in particular, the invention relates to methods of permanently repairing roofs against leakage of water. The repair can be made on any portion of the roof, including flat sections, joints between sections of a roof and intersections of the roof and projecting structure that extends upwardly from the roof. In addition, the present invention relates to methods of installing asphalt shingles so as to obtain a permanent, water impervious seal between successive rows of the asphalt shingles on the roof.

2. State of the Art

Colloidal clay, such as sodium montmorillonite (commonly called bentonite) has the capacity to swell and gelatinize upon contact with water. This property of bentonite has been utilized to form structures used to block the flow of water. U.S. Pat. No. 3,186,896 discloses a preformed, moisture-impervious panel comprising a pair of spaced facing sheets interconnected by a corrugated strip. The voids between the strips and facing sheets are filled with a mass of colloidal clay such as bentonite. The panels are used as waterproofing barriers when installed against a below grade wall.

Sheets of water proofing materials are disclosed in U.S. Pat. Nos. 4,693,923 and 4,837,085. In accordance with these patents, bentonite particles are applied as a layer to one or both of the sides of a sheet of a flexible, water impervious material. The layers of bentonite are applied as a mixture of particles and an adhesive that adheres the particles to the sheet of material. The sheets of material containing the layer of bentonite particles adhered thereto are then used by being positioned between joints or seams of a structure such as joints or seams formed between successive pours of a concrete foundation or footing.

In U.S. Pat. No. 5,158, there is disclosed a method of using bentonite to effect a temporary, emergency repair on a flat roof. In accordance with that patent, bentonite particles are spread by hand on accumulated water on the flat roof during a rainstorm. The bentonite particles mix with the accumulated water on the roof, and the mixture gravitates to and into cracks and holes that otherwise allow water to leak through the roof. The particles of bentonite swell when mixed with the water on the roof to form a gel which tends to temporarily clog the leaks in the roof. It is specifically taught that a permanent roof repair must be effected after the rainstorm is over and the roof has dried. The permanent repair comprises removing the bulk of the bentonite and applying a conventional organic roof repair product to the roof. A search of the prior art represented by issued U.S. patents did not reveal any patents which even remotely suggested a method of using bentonite to effect a permanent repair of a roof.

OBJECTIVES AND BRIEF DESCRIPTION OF THE INVENTION

A principal objective of the invention is to provide a novel method of permanently repairing roofs against leakage of water as well as sealing a roof to a projecting structure that extends upwardly from the roof using a water-swellable colloidal clay such as sodium montmorillonite.

A particular objective of the present invention is to provide a novel method of using water-swellable colloidal clay such as sodium montmorillonite to effect a permanent repair on any portion of a roof, including repairs on both flat and sloped sections of a roof as well as repairs at joints between sections of a roof and intersections of a roof and projecting structure that extends upwardly from a roof.

Another objective of the present invention is to provide a novel method of installing asphalt shingles using a water-swellable colloidal clay such as sodium montmorillonite to obtain a permanent, water impervious seal between successive rows of the asphalt shingles on a roof.

The above objectives are achieved in accordance with the present invention by providing novel methods of utilizing water swellable, colloidal clay such as sodium montmorillonite to effect permanent, water impervious repairs on existing roofs as well as to provide a permanent, water impervious seal for projecting structures that extend upwardly from new or existing roofs. In addition, the invention provides a novel method of installing asphalt shingles on a roof whereby a permanent, water impervious seal is achieved between successive rows of the asphalt shingles.

The methods of the present invention are ideally suited to effect permanent repairs on any portion of an existing roof that has developed leaks. Repairs can be made to holes or cracks in the roofing material on the flat or sloped sections of a roof or at the intersection of two sections of a roof. When repairing a hole or crack in the roofing material of a flat or sloped portion of a roof, a layer of particles of the colloidal clay are spread .over an area of the exterior surface of the roofing material in which the hole or crack is located. The layer of particles is made to fully encompass or encircle the hole or crack in the roofing material. A membrane of water impermeable material is then secured over the layer of particles so as to be in contact with the layer of particles. The membrane acts to retain the colloidal clay on the roof between the roofing material and the membrane at all times. When it rains, water contacts the colloidal clay, and the colloidal clay expands to form a blockage and seal between the roofing material and the membrane to thereby prevent water from infiltrating to the crack or hole in the roofing material. The layer of colloidal clay is permanently retained between the membrane and the roofing material and thus acts as a permanent repair and barrier preventing water from leaking through the crack or hole in the roofing material.

If the leakage in the roof is caused by a crack or opening that occurs at an intersection of two sections of a roof wherein the first section forms a joint with a second section, a layer of particles of the colloidal clay is spread on the two sections of the roof and over the joint between the two sections, with the layer of particles fully encompassing or encircling the portion of the joint in which the opening is located. A membrane of water impermeable material is then secured over the layer of particles so as to be in contact with the layer of particles on each section of the roof.

Intersections between a roof and a projecting structure that extends upwardly from the roof can be permanently sealed by placing a first layer of particles of a colloidal clay over the roof near the intersection between the roof and the projecting structure. A second layer of the same particles is placed onto the surface of the projecting structure near the intersection between the roof and the projecting structure. A membrane of water impermeable material is then secured over the first and second layers of particles so that the membrane lies over both the intersection between the roof and the projecting structure as well as the first and second layers of the particles.

The present invention also provides a novel method of installing asphalt shingles wherein a permanent, water impervious seal is achieved between successive rows of the asphalt shingles on a roof. After a first row of shingles has been installed, a layer of particles of the colloidal clay are spread over the upper side of the first row of shingles that is to be overlaid with a subsequent, second row of shingles. The second row of shingles is then installed so that the lower side of the second row of shingles overlies the layer of particles on the first row of shingles.

Additional objects and features of the invention will become apparent from the following detailed description, taken together with the accompany drawings.

THE DRAWINGS

Preferred embodiments of the present invention representing the best modes presently contemplated of carrying out the invention are illustrated in the accompanying drawings in which.

DETAILED DESCRIPTION OF THE ILLUSTRATED EMBODIMENTS

In one preferred embodiment of the invention, a method is provided for permanently repairing a planar area of a roof. The roof can be a substantially flat roof or can have a pitch. The method will be described by reference to FIGS. 1 and 2 which show a section of a roof that has been repaired in accordance with the invention.

A layer 12 of particles is spread over the roofing material forming the exterior surface of the roof in the area that is to be repaired. The layer 12 of particles is spread so as to have a thickness of between about 1/16 to 1/4 of an inch. The particles forming the layer 12 comprise a material that is capable of swelling when in contact with water. Preferably, the particles comprise a colloidal clay such as sodium montmorillonite which is commonly called bentonite.

The particles are spread on the roofing material 14 so that the layer 12 fully encompasses or encircles the crack or opening 16 in the roofing material 14. Generally, the layer 12 of particles will extend outwardly from the crack or opening 16 in the roofing material by several inches, i.e., by at least about 2 or 3 inches or greater. Preferably, the layer 12 of particles will extend from all directions from the crack or opening 16 by at least about 2 or 3 inches or more.

A membrane 20 of water impermeable material is then applied over the layer 12 of particles so that the membrane 20 lies over the layer 12 of particles and is in contact with the layer 12 of particles. The membrane 20 can be formed of any water impervious sheet material used in constructing roofs. Preferably, the sheet material is made of a polymeric material that contains stabilizers as well known in the trade for resisting ultra violet radiation and other weather related deterioration. Most preferably, the membrane 20 is made of an elastomeric type polymeric material that contains ultra violet stabilizers. Sheets of such polymeric material are presently used in roof construction and are readily available. The membrane 20 preferably has a thickness of between about 10 and 100 mils.

Figure 1:
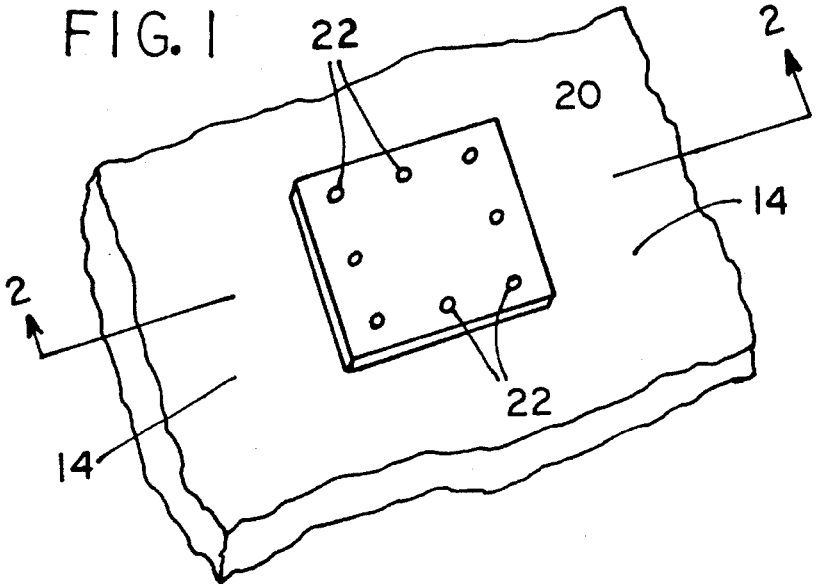
FIG. 1 is a pictorial representation of a section of a roof showing an area that has been repaired in accordance with the present invention.
Figure 2:
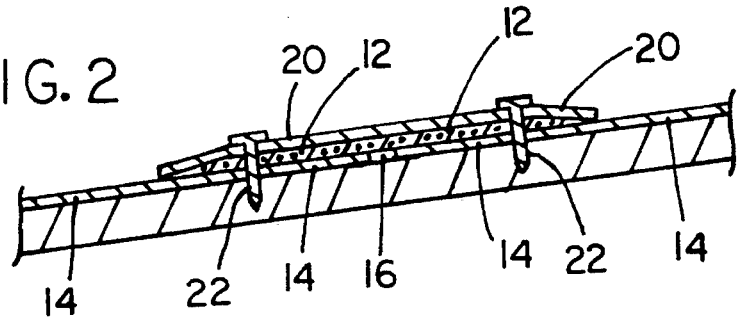
FIG. 2 is a cross section taken along line 2—2 of FIG. 1.

The membrane 20 is advantageously secured over the layer 12 of particles by driving elongate fasteners 22 through the membrane 20 and the layer 12 of particles into the structural support for the roof. The elongate fasteners 22 can be nails as shown in FIGS. 1 and 2, but other well known fasteners such as staples and screws and disks can also be used.

It has been unexpectedly found that the layer 12 of colloidal clay particles is retained indefinitely between the membrane 20 and the roofing material 14. Wind will not remove the layer 12 of colloidal clay, and the clay swells rapidly when contacted by rain water and cannot be washed away. The layer 12 of colloidal clay will remain for a time in excess of the life of the roof. When it rains, the rain water contacting the colloidal clay causes the clay to swell as is well known in the art. The clay swells sufficiently to form a blockage to the infiltration of water between the membrane 20 and the roofing material 14. Rain water is prevented from infiltrating to the crack or opening 16 in the roofing material 14 and thus leakage of water through the crack or opening 16 is effectively prevented.

After the rain storm has subsided, the layer 12 of colloidal clay dries out and remains in place between the membrane 20 and the roofing material 14 until the next rain. The colloidal clay again swells so as to prevent water from infiltrating to the crack or opening 16 in the roofing material 14 each time that it rains and the colloidal clay is wetted with water. The layer of colloidal clay will remain in place between the membrane 20 and the roofing material 14 for a period of time exceeding the life of the roof. Accordingly, the repair is permanent, and as can be appreciated from the above description, the repair is accomplished very quickly and easily and is inexpensive.

In a slight modification of the method described previously, an area of a roof can be repaired wherein a first section of the roof forms a joint with a second section of the roof. The second section may have a slope that is different than the slope of the first section, but two adjoining sections of the same pitch can also be repaired. This modified method will be described with reference to FIGS. 3 and 4 which show a roof repaired in accordance with the modified method.

A layer 12 of particles is spread over the area of the roof that is to be repaired. The layer 12 of particles has a thickness of between about 1/16 to 1/4 of an inch and extends at least about three inches on each side of the joint 30 formed by the adjoining section of the roof. The layer 12 is spread along a sufficient length of the joint 30 so as to cover entirely any opening in the roof through which water could otherwise infiltrate. A membrane 20 of water impermeable material similar to that described above is secured over the layer 12 of particles so that the membrane 20 lies over the layer 12 of particles and is in contact with the layer 12 of particles.

Figure 3:
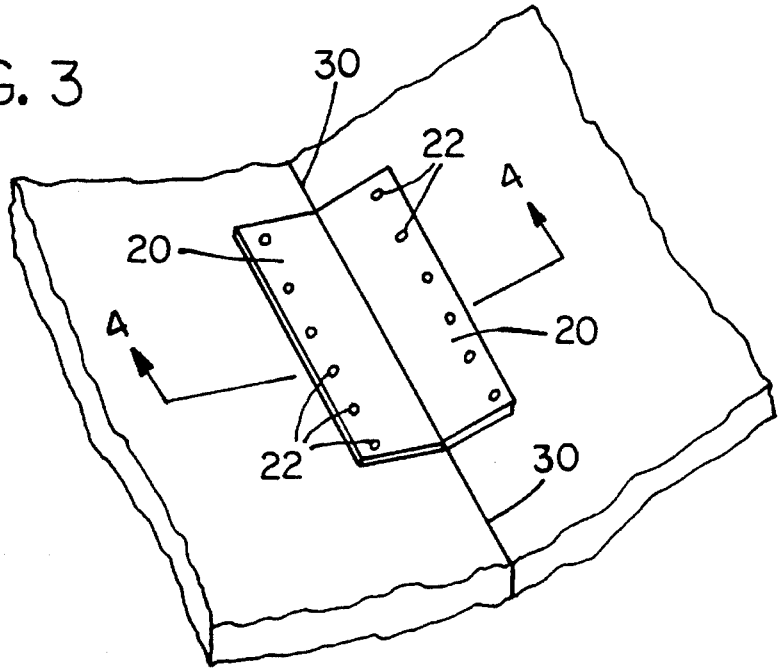
FIG. 3 is a pictorial representation of a roof having two sections in which the first section intersects the second section in a linear joint with an area along the joint having been repaired in accordance with the present invention.
Figure 4:
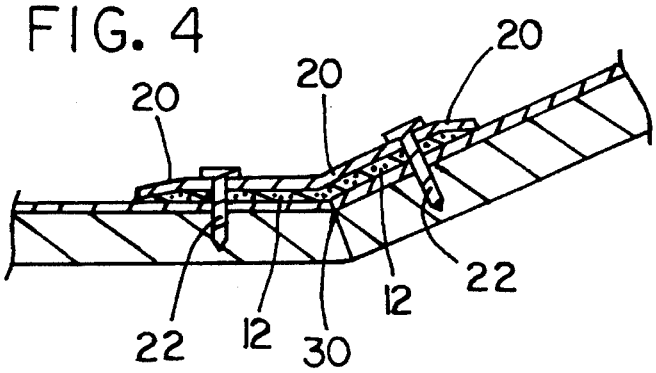
FIG. 4 is a cross section taken along line 4—4 of FIG. 3.

As described previously, the membrane 20 can be secured over the layer 12 of particles by driving elongate fasteners 22 through the membrane 20 and the layer 12 of particles into the structural support for the roof. Again, the elongate fasteners 22 can be nails as shown in FIGS. 3 and 4 or other well known fasteners such as staples and screws and disks which are not illustrated. It is to be noted that the nails or staples are preferably driven through the layer 12 of particles. This will form a seal for the nails or staples inasmuch as any water infiltrating along the nails or staples will wet the colloidal clay, and the clay will swell against the nails or staples to prevent further infiltration of water along the nails or staples.

In another embodiment of the present invention, the intersection between a roof and a projecting structure that extends upwardly from the roof can be readily and inexpensively sealed so as to be water tight. The method is advantageously used to seal around stand pipes 50 as shown in FIGS. 5 and 6.

A layer 12 of particles is spread over the roof near the intersection between the roof and the projecting structure, in this case, the stand pipe 50. The layer 12 of particles is spread over the roof and onto the surface of the stand pipe 50 near the intersection between the roof and the stand pipe 50. The layer of particles will generally have a thickness of between about 1/16 to 1/4 of an inch. A membrane 20 of water impermeable material is secured over the first and second layers of particles so that the membrane 20 lies over both the intersection between the roof and the stand pipe 50 as well as the first and second layers 12 of particles. The membrane 20 has a thickness of between about 10 to 100 mils.

Figure 5:
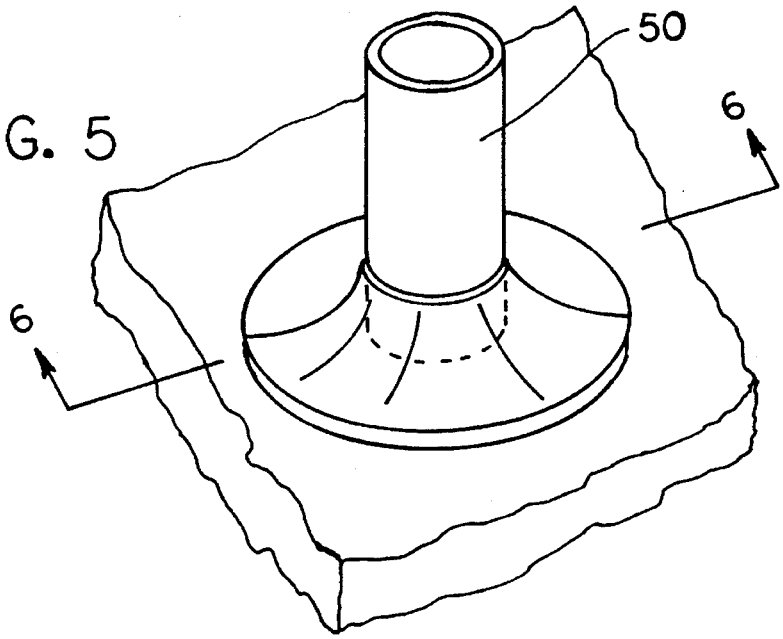
FIG. 5 is a pictorial representation of a roof having a stand pipe extending upwardly through the roof with the stand pipe and roof being sealed against water infiltration through the roof by a method in accordance with the present invention.
Figure 6:
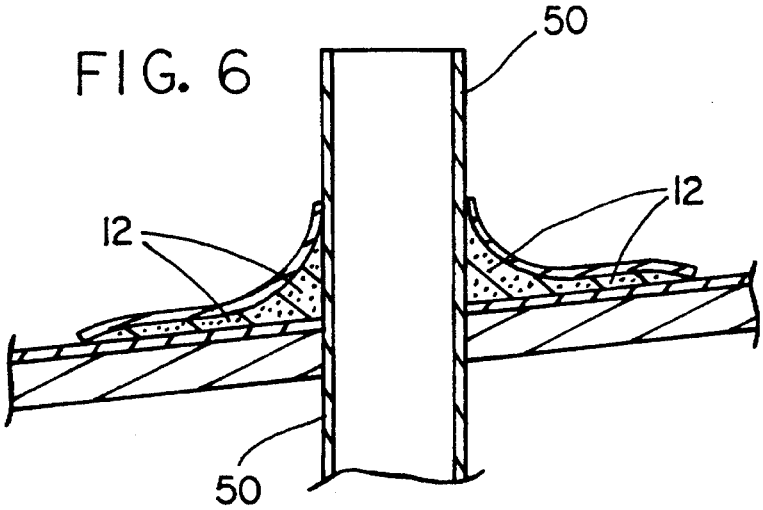
FIG. 6 is a cross section taken along the line 6—6 of FIG. 5.

When the projecting structure is a stand pipe as illustrated in FIGS. 5 and 6, the membrane 20 is preferably a circular boot made of elastomeric material. The central opening in the boot is just slightly smaller than the outer circumference of the the stand pipe, so that the boot can be pulled down over the stand pipe, with the central opening in the boot fitting snugly around the stand pipe and over the layer of particles on the stand pipe. The outer perimeter of the boot is positioned over the layer of particles on the roof, and nail or staples can be driven through the boot and into the structural support for the roof if desired to hold the boot firmly in place.

When the projecting structure is something other than a stand pipe (such as an elevated support deck for equipment mounted on a roof) and is made of wood or other material into which nails or staples can be driven, the membrane 20 takes the form of an elongate, wide ribbon of material that is secured to the roof and the projecting structure with nails or staples. The projecting structure need not be circular in shape, but can be square or rectangular.

Figure 7:
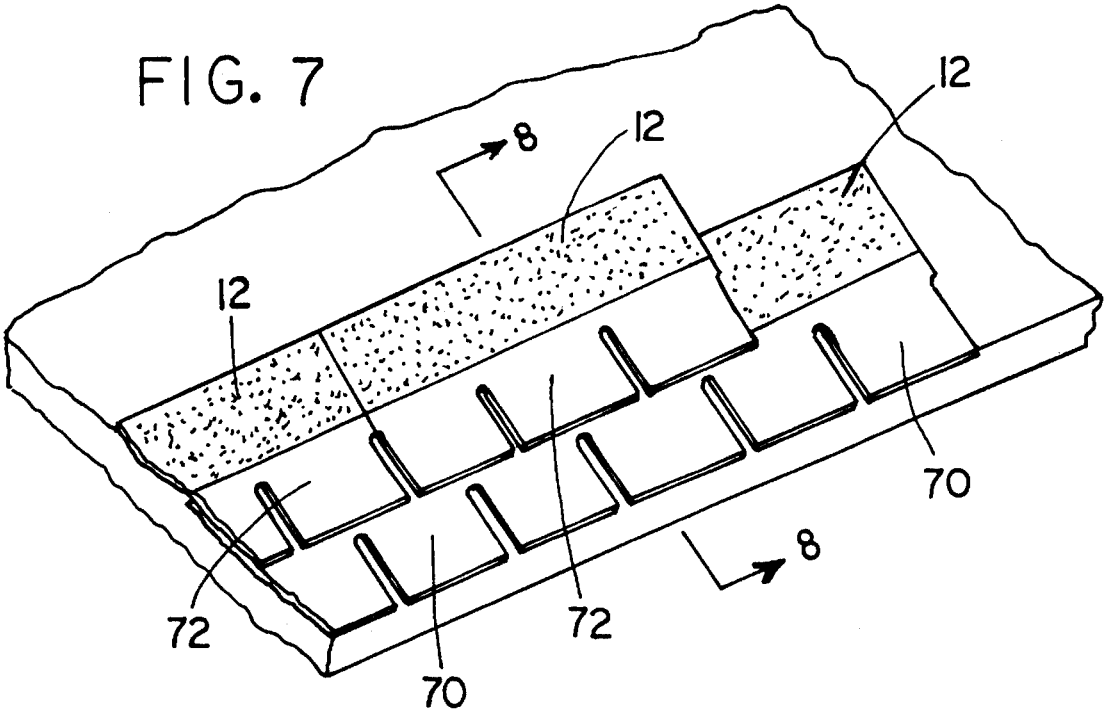
FIG. 7 is a pictorial representation of two rows of asphalt shingles that are being installed on a roof in accordance with the present invention.
Figure 8:
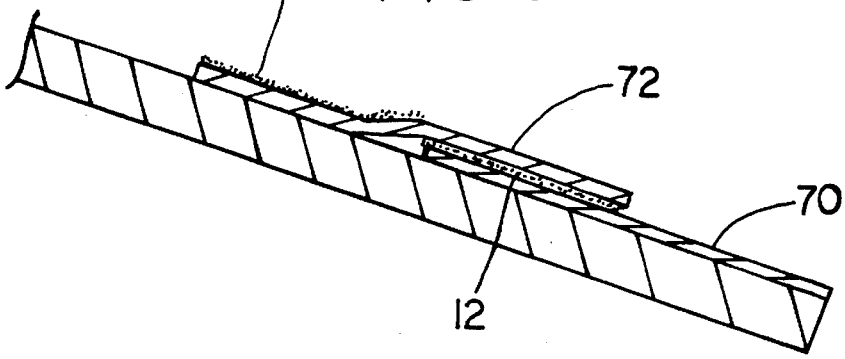
FIG. 8 is a cross section taken along line 8—8 of FIG. 7.

In yet another embodiment of the invention, a method is provided for permanently sealing an upper side edge of a first row of asphalt shingles to the lower side edge of a subsequent, overlying, second row of asphalt shingles as the shingles are being installed on a roof. Two rows of shingles as they are being installed on a roof in accordance with the present invention are shown in FIGS. 7 and 8.

The first row 70 of shingles is secured to the roof, and a layer 12 of particles of colloidal clay is spread over the upper side of the first row 70 of shingles that is to be overlaid with the subsequent, second row 72 of shingles. The layer 12 of particles has a thickness of between about 1/16 and 1/4 of an inch.

The shingles in the second row 72 of shingles are secured to the roof so that the lower side of the second row of shingles overlies the layer 12 of particles on the first row 70 of shingles.

The method of installing asphalt shingles in accordance with the present invention is especially advantageous when the pitch of the roof is small, and the roof is subjected to freezing temperatures. Under such conditions, an ice dam commonly forms at the eaves of the roof, and a body of water builds up behind the ice dam. This built up body of water can infiltrate between rows of the shingles near the eaves of the roof and leak .into the building. The layer of colloidal clay of the present invention quickly swells and forms a blockage and seal between rows of the asphalt shingles when the clay is wetted with water. The seal formed by the swollen layer of colloidal clay prevents water from infiltrating between rows of shingles and then into the building.

Although preferred embodiments of the method of the present invention have been illustrated and described, it is to be understood that the present disclosure is made by way of example and that various other embodiments are possible without departing from the subject matter coming within the scope of the following claims, which subject matter is regarded as the invention.

I claim:

1. A method of permanently repairing a roof comprising:

placing a layer of particles that are capable of swelling when in contact with water over an area of the roof that is to be repaired, said layer of particles having a thickness of between about 1/16 to 1/4 of an inch; and securing a membrane of water impermeable material over the layer of particles so that said membrane lies over said layer of particles and is in contact with said layer of particles, said membrane having a thickness of between about 10 to 100 mils.

2. A method in accordance with claim 1 wherein said membrane is secured over the layer of particles by driving elongate fasteners through the membrane and the layer of particles into the roof.

3. A method in accordance with claim 2 wherein said elongate fasteners are nails.

4. A method in accordance with claim 2 wherein said elongate fasteners are staples.

5. A method in accordance with claim 1 wherein said particles comprise sodium montmorillonite.

* * * * *